US009398825B2

(12) United States Patent
Kresta

(10) Patent No.: US 9,398,825 B2
(45) Date of Patent: Jul. 26, 2016

(54) BOTTLE CROSS FRAME AND METHOD FOR MAKING A BOTTLE CROSS

(71) Applicant: Richard Kresta, Edna, TX (US)

(72) Inventor: Richard Kresta, Edna, TX (US)

( * ) Notice: Subject to any disclaimer, the term of this patent is extended or adjusted under 35 U.S.C. 154(b) by 158 days.

(21) Appl. No.: 14/229,875

(22) Filed: Mar. 29, 2014

(65) Prior Publication Data

US 2015/0272368 A1 Oct. 1, 2015

(51) Int. Cl.

| | |
|---|---|
| ***A47B 73/00*** | (2006.01) |
| ***A47B 43/00*** | (2006.01) |
| ***A47B 47/00*** | (2006.01) |
| ***A47B 57/00*** | (2006.01) |
| ***A47G 33/02*** | (2006.01) |
| ***B44F 7/00*** | (2006.01) |
| ***A47G 25/06*** | (2006.01) |
| ***A47F 5/04*** | (2006.01) |

(52) U.S. Cl.

CPC ..... *A47G 33/02* (2013.01); *A47B 73/00* (2013.01); *A47F 5/04* (2013.01); *A47G 25/0664* (2013.01); *B44F 7/00* (2013.01)

(58) Field of Classification Search

CPC ..... B44F 7/00; A47G 33/02; A47G 23/02; A47G 23/0241; A47G 25/0664; A47B 73/00; A47B 73/004; A47B 73/008; A47F 7/28; A47F 7/283; A47F 7/286; A47F 7/288; A47F 5/04; A47F 5/106; A47F 5/05; D06F 57/04; F16M 11/04

USPC ..... 211/74, 196, 197, 205, 13.1, 189; 40/743; 312/33; 362/121

See application file for complete search history.

(56) References Cited

U.S. PATENT DOCUMENTS

| | | | | |
|---|---|---|---|---|
| 637,963 | A | 11/1899 | Howard | |
| 962,185 | A * | 6/1910 | White | A47F 5/04 211/183 |
| 1,073,763 | A * | 9/1913 | Kalitzky | A47G 25/0664 211/196 |
| 2,650,717 | A * | 9/1953 | Larson | A47F 5/04 211/116 |
| 2,728,488 | A * | 12/1955 | Hankins | F16N 33/00 141/106 |
| 2,781,065 | A * | 2/1957 | Hofacer | F16N 33/00 141/106 |
| 2,781,596 | A * | 2/1957 | Curran | A47G 33/02 428/3 |
| 3,021,960 | A * | 2/1962 | Pipe | A47B 13/023 211/205 |
| 3,091,343 | A * | 5/1963 | Neumann | A47J 47/16 126/25 R |

(Continued)

*Primary Examiner* — Jennifer E Novosad

(74) *Attorney, Agent, or Firm* — Kammer Browning PLLC

(57) ABSTRACT

A bottle cross frame and method for making a bottle cross. The bottle cross frame provides a metal framework structured to receive four bottles, typically of wine bottle shape and size, and to retain the bottles in a cross shape. The frame includes a top post for receiving a single upside down bottle, as well as two side arms to each receive a single bottle to form the lateral arms of the cross. A base of the cross is formed by positioning a bottle upright between a base pin and a bottom bracket positioned along a stand component. The frame includes a stake stand component and an alternate bracket component.

18 Claims, 5 Drawing Sheets

(56) References Cited

U.S. PATENT DOCUMENTS 3,190,454 A * 6/1965 Brooks ..... A47F 5/04 211/85.21
3,310,180 A * 3/1967 Neagle ..... A47G 25/0664 211/189
3,315,819 A * 4/1967 Kingsbery ..... A47F 5/04 211/163
3,357,570 A * 12/1967 Hagle, Sr. ..... A47F 5/04 211/125
3,513,986 A * 5/1970 Schier ..... A47F 5/04 211/1
3,664,496 A * 5/1972 Mascia ..... B65D 71/50 206/151
4,468,421 A 8/1984 Wang
4,485,929 A * 12/1984 Betts, Sr. ..... B01L 9/00 211/59.1
4,865,283 A * 9/1989 Parker ..... A47F 5/04 108/191
5,037,390 A * 8/1991 Raines ..... A61J 3/002 211/74
5,197,612 A 3/1993 Thomson
5,318,189 A * 6/1994 Lee ..... A47G 25/0664 211/196
5,522,437 A * 6/1996 Blackburn ..... F16N 33/00 141/106
5,564,816 A * 10/1996 Arcadia ..... A47G 33/02 362/121
5,906,277 A * 5/1999 Vienneau ..... A63C 11/026 206/287.1
6,038,784 A * 3/2000 Dunn ..... A47L 19/04 211/41.6
6,443,316 B1 * 9/2002 Mao ..... A47F 5/0807 211/41.3
6,539,989 B1 * 4/2003 Walden ..... F16N 31/002 141/106
6,702,129 B1 * 3/2004 Harris ..... A47G 25/0664 211/172
7,207,450 B1 * 4/2007 Franklin ..... A45F 3/44 108/25
7,241,043 B1 7/2007 Wu
7,556,053 B2 * 7/2009 Hansen ..... F41H 3/02 135/114
8,033,402 B1 10/2011 Bevis
D680,393 S 4/2013 Hendrick et al.
2004/0144740 A1 * 7/2004 Przygoda ..... A47F 7/28 211/74
2005/0236532 A1 * 10/2005 Bain ..... A47G 25/0664 248/158
2006/0043035 A1 * 3/2006 Madsen ..... A47F 7/283 211/74
2006/0070968 A1 * 4/2006 Terhune ..... A47G 23/02 211/205
2007/0125725 A1 * 6/2007 Kemper ..... A47L 19/04 211/41.3
2009/0296421 A1 12/2009 Fernandez-Espana
2010/0034990 A1 * 2/2010 Chen ..... G10K 1/26 428/11
2015/0272368 A1 * 10/2015 Kresta ..... B44F 7/00 428/3

* cited by examiner

BOTTLE CROSS FRAME AND METHOD FOR MAKING A BOTTLE CROSS

BACKGROUND OF THE INVENTION

1. Field of the Invention

The present invention relates generally to frame structures for facilitating the creation of three-dimensional ornamental objects. The present invention relates more specifically to structural frames for creating three-dimensional ornamental objects based on the use of empty glass bottles and the like.

2. Description of the Related Art

It is known to create artistic three-dimensional sculptures and the like from empty glass bottles and other similarly shaped objects that may be placed on or hung from branches and tree-like bases and frames. More specifically, it is known to create what are referred to as bottle trees that include branches onto which a number of clear or colored glass bottles may be positioned and retained. While there is a wide variety of creative designs associated with such bottle trees, they are generally limited to randomly shaped structures that allow the bottles to be retained upside down on the branches by gravity. Such bottle tree structures are often constructed of actual tree branches or of metal rods that are shaped into the general configuration of a tree, with bottles having necks sized to fit over the rods (or the tree branches) and to remain suspended there as the three-dimensional ornamental object is displayed. The most common structural framework for such ornamental bottle trees is one made from metal rebar or other small metal rod stock, typically on the order of one-half inch diameter.

Implementation of a bottle tree as anything other than a structure that allows the bottles to be turned upside down and positioned over the upright metal rods forming the branches, has generally not occurred for a number of reasons. First, as mentioned above, it is generally desirable to have the bottles retained in place by means of gravity, thus simplifying and minimizing the requirements for the framework structure. Secondly, orienting the bottles in a downward position over the upright metal rods tends to desirably prevent the collection of rain water within the bottles as they are retained on the tree framework. In general, therefore, creation of bottle trees has been limited to structures with upright rods that may receive a bottle in an upside down orientation that allows gravity to maintain the bottle in place and prevents the accumulation of rain water within the bottle during display.

For the above reasons, there has been little or no effort to create identifiable decorative or ornamental three-dimensional structural elements based on the bottle tree design for such common icons as a cross. A cross is, of course, a significant and common religious symbol that is frequently utilized in decorative, ornamental, or liturgical environments. While it might be desirable to construct a three-dimensional cross based upon the basic concepts of a bottle tree, the above mentioned limitations have generally prevented this from occurring.

A cross typically incorporates four branches (a base, a top, and two side branches) but it is only the top branch that lends itself easily to the incorporation of a bottle for the cross component. The side branches might enjoy the use of bottles for creating a cross, but here a straight lateral orientation will retain the risk that the bottles will slide off of the cross structure, or still accumulate rain water. The base of a cross is, of course, the most difficult component to address when considering the use of the basic bottle tree concept in creating the three-dimensional symbolic structure. Not only does gravity generally prevent the simple attachment of a bottle to the base branch of a cross, but most bottles would quickly fill with rain water if exposed to the elements in this upright orientation for any length of time. There has therefore been little effort to create three-dimensional ornamental objects, such as a symbolic cross structure, based upon the bottle tree basic concept.

SUMMARY OF THE INVENTION

The present invention, therefore, provides a bottle cross frame and a method for making a bottle cross that solves the problems associated with the specific orientation of bottles on the cross frame as well as the undesirable accumulation of rain water when the three-dimensional structure is exposed to the elements. The present invention provides a metal framework structured to receive four bottles, typically of wine bottle shape and size, that retains the bottles in a cross shape and generally prevents their falling from the frame during display of the three-dimensional sculpture. The frame structure further prevents the collection of rain water when the three-dimensional object is exposed to the elements. The cross-shaped frame includes a top post for receiving a single upside down bottle to form the top branch of the cross, as well as two side arms to each receive a single bottle to form the two lateral branches of the cross. A base of the cross is formed by positioning a bottle upright between a base pin positioned at the junction of the side arms, and a bottom bracket positioned lower down on a stand component for the cross structure. Additional features maintain the bottles in specific orientations on the framework and either seal the bottles against the collection of rain water (as in the case of the base bottle) or angle the bottles in such a way as to allow any collected water to easily drain from the bottle. The frame includes a stake stand component that allows the constructed bottle cross to be staked into the ground for display, and an alternate bracket component that allows the constructed bottle cross to be mounted to a wall or fence.

DETAILED DESCRIPTION OF THE PREFERRED EMBODIMENTS

Figure 1A:
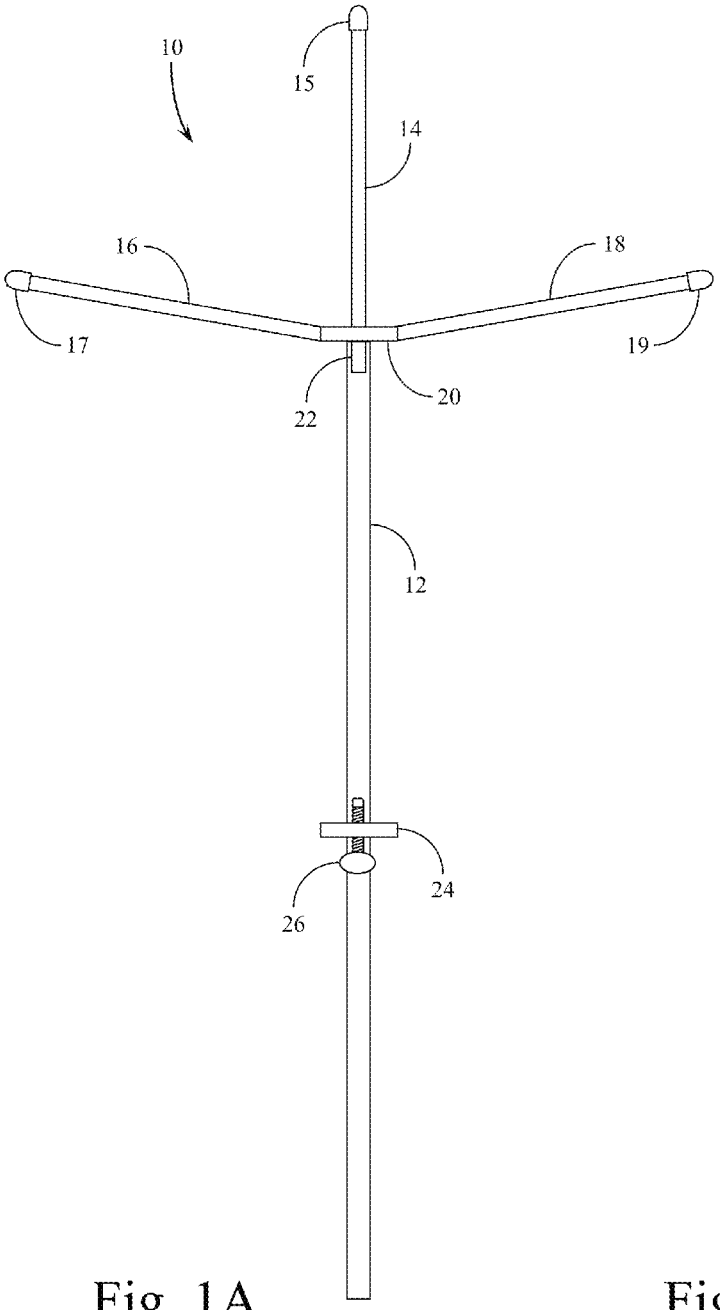
FIG. 1A is an elevational front plan view of the frame component of the bottle cross assembly system of the present invention.
Figure 1B:
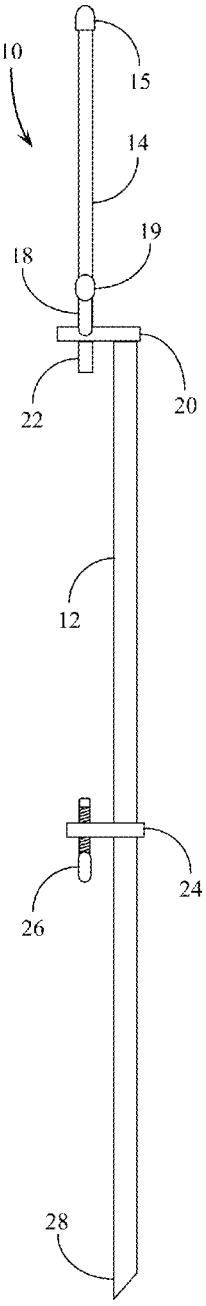
FIG. 1B is an elevational side view of the frame component of the bottle cross assembly system of the present invention.

Reference is made first to FIGS. 1A & 1B for a description of the overall frame structure that forms the core of the three-dimensional object, the creation of which the present invention is directed. Although the final product is ornamental in nature, the frame of the present invention comprises a structural support member onto which the user may construct a bottle cross of their choice of colors and configurations. As will become apparent to those skilled in the art, the frame of the present invention may be utilized in conjunction with a wide array of bottle sizes and colors. In general, the frame structure is configured to receive and secure bottles of the wine bottle type, having a narrow neck with a wider base and a tall profile. There are, however, a wide variety of bottles available to the user that may be equally suitable for constructing the desired ornamental cross. The frame of the present invention is structured to receive such bottles of a variety of sizes, and may itself be constructed in different sizes to accommodate small, medium, or large bottles, and to therefore create bottle crosses in different sizes.

FIG. 1A is an elevational front plan view of frame 10 of the overall assembly system of the present invention. Frame 10 is constructed primarily of base rod 12 which supports top post 14 as well as first arm 16 and second arm 18. These four branches of the cross come together at center bracket 20 to which each of the branches is permanently attached. Frame 10 of the present invention is preferably constructed of sections of metal rod that may be welded together at the center point of the cross. Central bracket 20 may be welded to base rod 12 as well as top post 14, on the bottom and top respectively of the center bracket. First arm 16 and second arm 18 may preferably be welded to the sides of center bracket 20 as shown.

In the preferred embodiment, base rod 12 extends downward in a manner that eventually forms a stake support for the overall frame structure. Base rod 12 does not itself retain the lower bottle that forms the base of the cross, but instead supports separate components to retain this bottle. On the other hand, top post 14 is oriented vertically to receive and retain an inverted bottle that is held in place by gravity, while first arm 16 and second arm 18 are oriented to the sides, tilted up slightly so as to again retain bottles thereon against gravity and at the same time to allow drainage of any collected rain water from the bottles. Each of the two arms 16 & 18, as well as top post 14, are preferably terminated with caps (post cap 15, arm cap 17, and arm cap 19) made of rubber or other resilient material to contact the inside base wall of the bottle inserted onto that particular branch of the cross.

The base bottle of the cross to be formed using frame 10 is intended to be positioned upright, parallel to, and in front of base rod 12, secured between base pin 22 and bottom bracket 24. Base pin 22 is sized to be inserted into the neck of the base bottle and prevent the bottle's lateral movement. Bottom bracket 24 is designed to adjustably support the bottom of the base bottle to be positioned on frame 10. Adjustable support pin 26 allows the base bottle to be positioned on base pin 22 on top of bottom bracket 24 and then tightened so as to be secured in place.

FIG. 1B shows in greater detail the manner in which the base bottle is to be positioned parallel and in front of base rod 12, secured between base pin 22 and bottom bracket 24. Also visible in FIG. 1B is stake point 28 formed on the lower end of base rod 12 to facilitate the insertion of base rod 12 into the ground to support the completed bottle cross.

Figure 2:
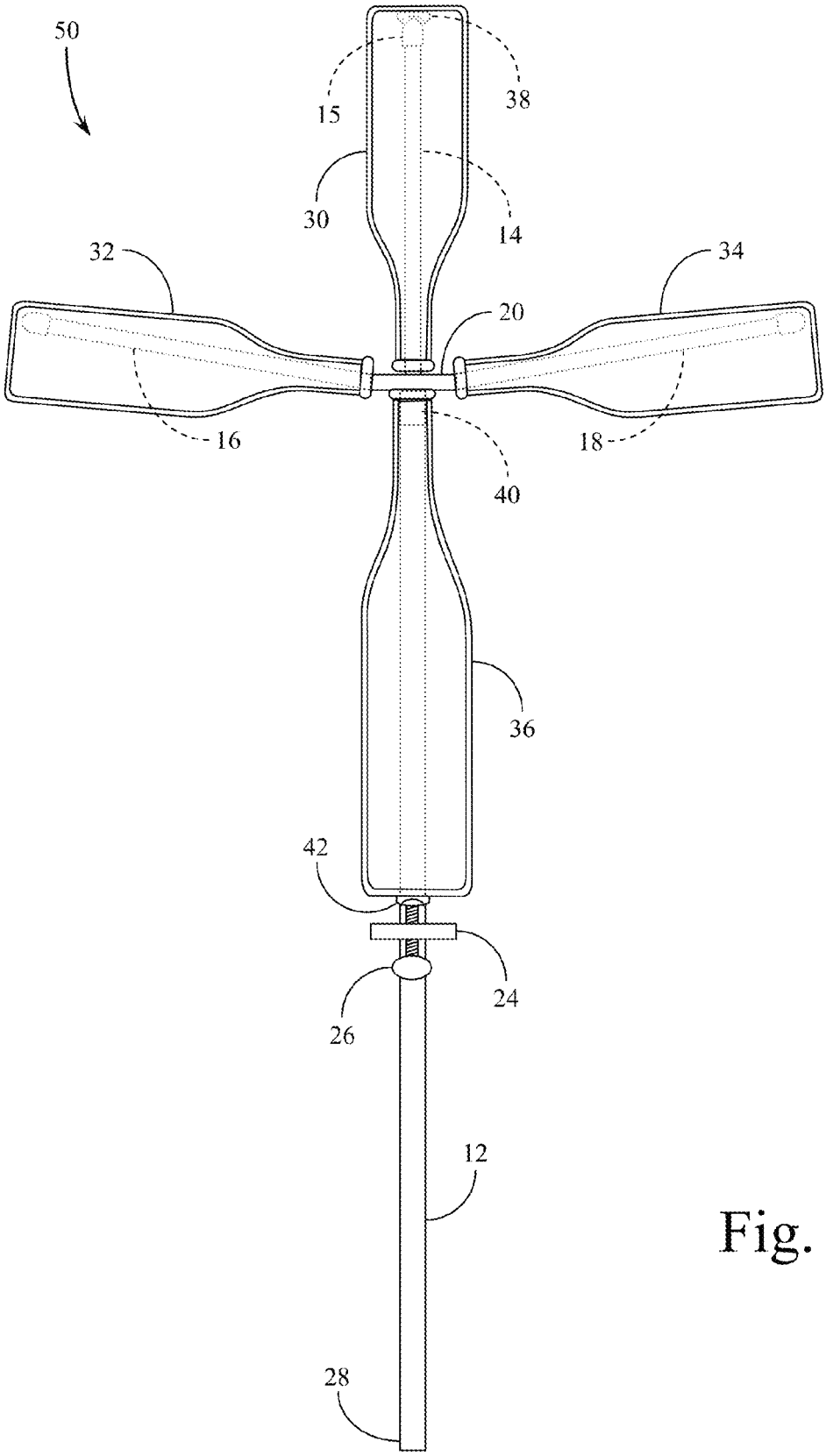
FIG. 2 is an elevational front plan view of an assembled cross utilizing the frame component of the present invention with four glass bottles.

Reference is next made to FIG. 2 which shows a completed bottle cross utilizing frame 10 of the present invention. Assembled cross 50 includes top bottle 30, first arm bottle 32, and second arm bottle 34, positioned on top post 14, first arm 16, and second arm 18, respectively as described above. Base bottle 36 is positioned over base pin 22 (not seen in FIG. 2) below center bracket 20, and is supported by bottom bracket 24 through adjustable support pin 26. Base bottle 36 is secured in place through the use of base plug 40 positioned around the base pin (not shown) and utilizes base centering washer 42 to fix the support of adjustable support pin 26 on bottom bracket 24 centered on the bottom of base bottle 36.

First arm bottle 32 and second arm bottle 34 are generally held in place on first arm 16 and second arm 18, respectively, by the slight upward angle of each of the arms welded to center bracket 20. Because the base of each bottle is typically much wider than the neck, the side bottles themselves end up being oriented nearly horizontal to create a more accurate appearance of a cross with cross arms only slightly elevated at the outside.

Top bottle 30 could be subject to tilting slightly to the side if its base was not approximately centered on top post 14. To facilitate this centering, top centering washer 38 may be positioned and adhered on the inside wall of the base of top bottle 30 in a manner that allows it to receive the point of post cap 15 as shown. Gravity will therefore keep top bottle 30 down on top post 14 and top centering washer 38 will generally reduce side to side wobble or mis-orientation of top bottle 30.

Base centering washer 42 is adhered to a central position on the outside wall of the bottom of base bottle 36 and performs a function similar to top centering washer 38, this time in conjunction with adjustable support pin 26. The manner in which base bottle 36 is secured between center bracket 20 and bottom bracket 24 is described in more detail below. In general, the configuration shown in FIG. 2 exhibits the manner in which a frame of the present invention may be utilized in conjunction with a wide array of bottles of different sizes, shapes, and colors. There is generally no limitation on the height of the bottles chosen for the arms of the cross, and only modest limitations on the height of the bottle chosen for the top of the cross. It is preferable that top bottle 30 be no taller than top post 14. There is nothing to prevent a taller bottle from being used, only that it would defeat the purpose of top centering washer 38.

Base bottle 36 has somewhat more critical constraints on its overall height, although providing significant variation in the effective height of bottom bracket 24 with adjustable support pin 26 will allow for base bottles of a wide range of heights.

Figure 3:
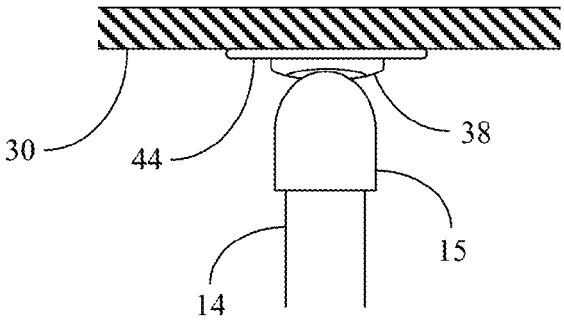
FIG. 3 is a detailed partial cross-sectional view of a centering structure for the top bottle of the assembled cross shown in FIG. 2.

Reference is next made to FIGS. 3-6 for detailed descriptions of the specific support components mentioned generally above. FIG. 3 shows in detail the manner in which top centering washer 38 may be positioned on the inside bottom wall of top bottle 30. Preferably, adhesive 44 is placed between top centering washer 38 and the inside bottom wall of top bottle 30. Such adhesive 44 may preferably be an epoxy or other faster drying adhesive and may be placed on the bottle by temporarily positioning the bottom face of top centering washer 38 (with adhesive) on the top of post cap 15, positioned over the end of top post 14, and carefully lowering the bottle over top post 14 while maintaining the bottle base centered over the post. Allowing the adhesive 44 to cure will allow the bottle to remain centered on the base and yet still be removed as necessary by lifting top centering washer 38 (now adhered inside the bottle) off of post cap 15.

Figure 4:
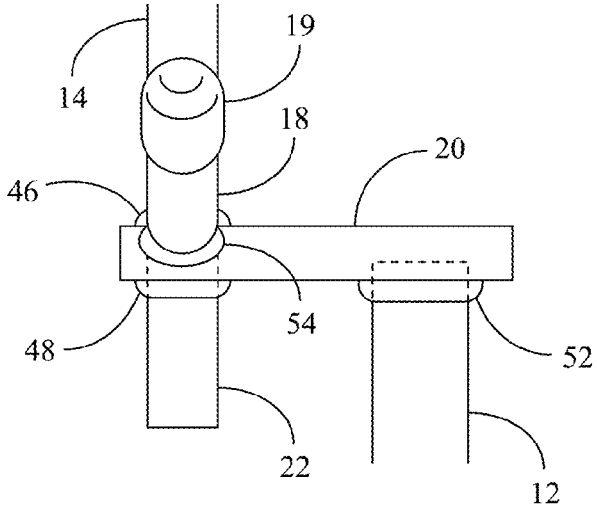
FIG. 4 is a detailed side view of the center bracket structure of the frame component of the present invention.

FIG. 4 shows in greater detail the arrangement of center bracket 20 forming the middle junction of the cross branches.

Center bracket 20 is supported on base rod 12 at weld 52. Top post 14 is secured to center bracket 20 by weld 46. Second arm 18 is secured to center bracket 20 by weld 54. A similar weld is provided for the first arm not shown in this view. Finally, base pin 22 is secured to center bracket 20 at weld 48. Base pin 22 may alternately be an extension of top post 14 through center bracket 20.

Figure 5:
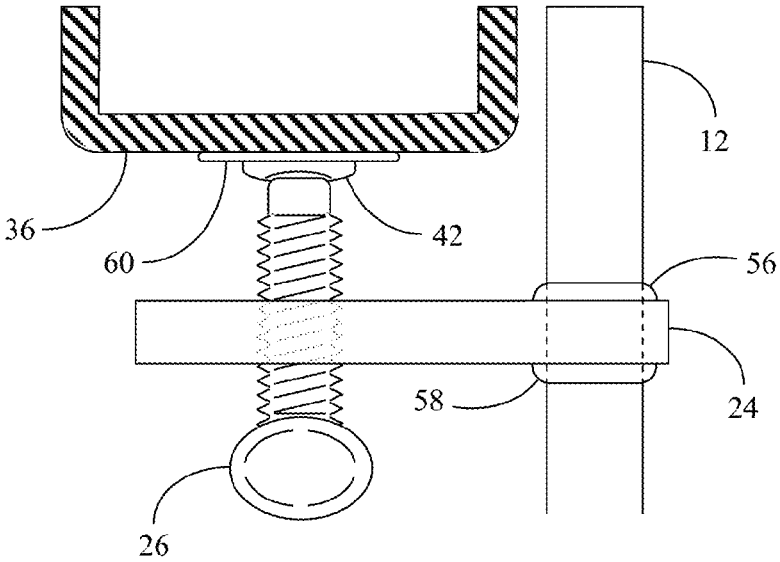
FIG. 5 is a detailed partial cross-sectional view of the bottom bracket of the assembled cross shown in FIG. 2.

FIG. 5 shows in detail the manner of fixing bottom bracket 24 onto base rod 12. Welds 56 and/or 58 secure bottom bracket 24 in place along the length of base rod 12. Bottom bracket 24 preferably comprises a plate with a threaded aperture through which adjustable support pin 26 is threaded to present an upward oriented post that is adjustable in height. Base centering washer 42 is secured to the outside wall of the bottom of base bottle 36 using adhesive 60. No special technique is required for securing base centering washer 42 externally to the base of base bottle 36.

Figure 6:
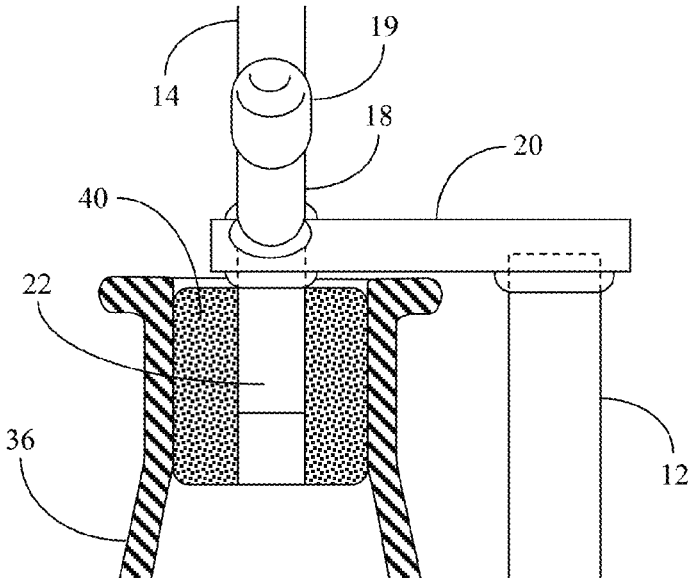
FIG. 6 is a detailed partial cross-sectional side view of the center bracket structure of the assembled cross shown in FIG. 2.

FIG. 6 shows in partial cross-sectional detail the manner in which base pin 22 is fixed within the neck of base bottle 36. Positioned within the neck of base bottle 36 is base plug 40 which is essentially a rubber stopper with a center aperture. Base pin 22 is directed into the center aperture of base plug 40 and thereby maintains the top of base bottle 36 in its proper position. This arrangement further prevents the incursion of rain water into base bottle 36 despite its upward orientation.

Figure 7:
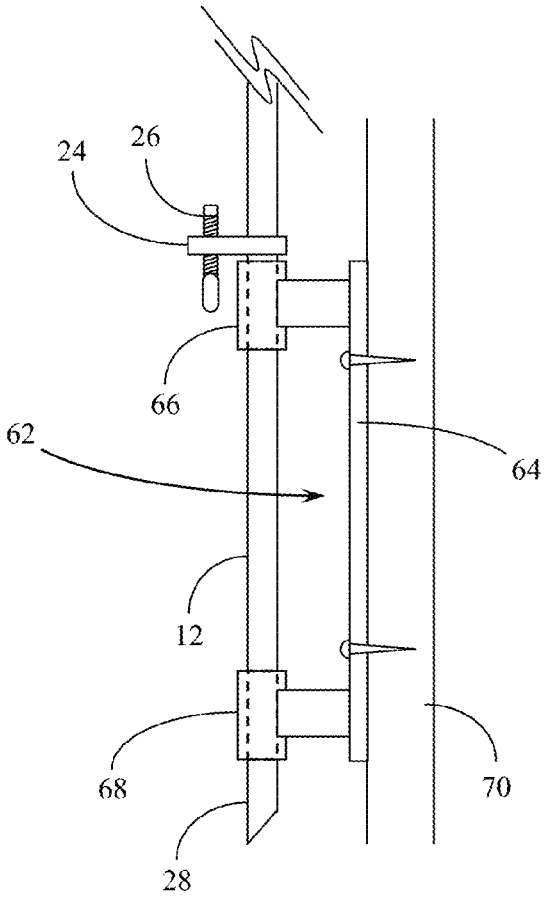
FIG. 7 is an elevational side view of the lower portion of the frame component of the assembly system of the present invention shown mounted in an optional wall bracket.

Reference is next made to FIG. 7 for one manner of securing the frame of the present invention (and therefore the constructed bottle cross) to a wall or fence. A preferable manner of displaying the constructed bottle cross may be in the ground utilizing the stake point 28 configured in base rod 12. Where the user desires to display the bottle cross on a vertical wall or fence, alternate mechanisms for mounting the bottle cross are provided. In FIG. 7 the same frame used for positioning the bottle cross in the ground may be attached to an ancillary wall bracket 62 that includes mounting plate 64 and positions upper sleeve 66 and lower sleeve 68 to receive base rod 12. In this manner, ancillary wall bracket 62 may be secured to wall section 70 as base rod 12 may be slipped into upper sleeve 66 and lower sleeve 68 to hold the frame, and therefore the constructed bottle cross, in its upright orientation. Ancillary wall bracket 62 includes offset struts that position the frame of the bottle cross sufficiently apart from the wall to make attachment and removal easy.

Figure 8A:
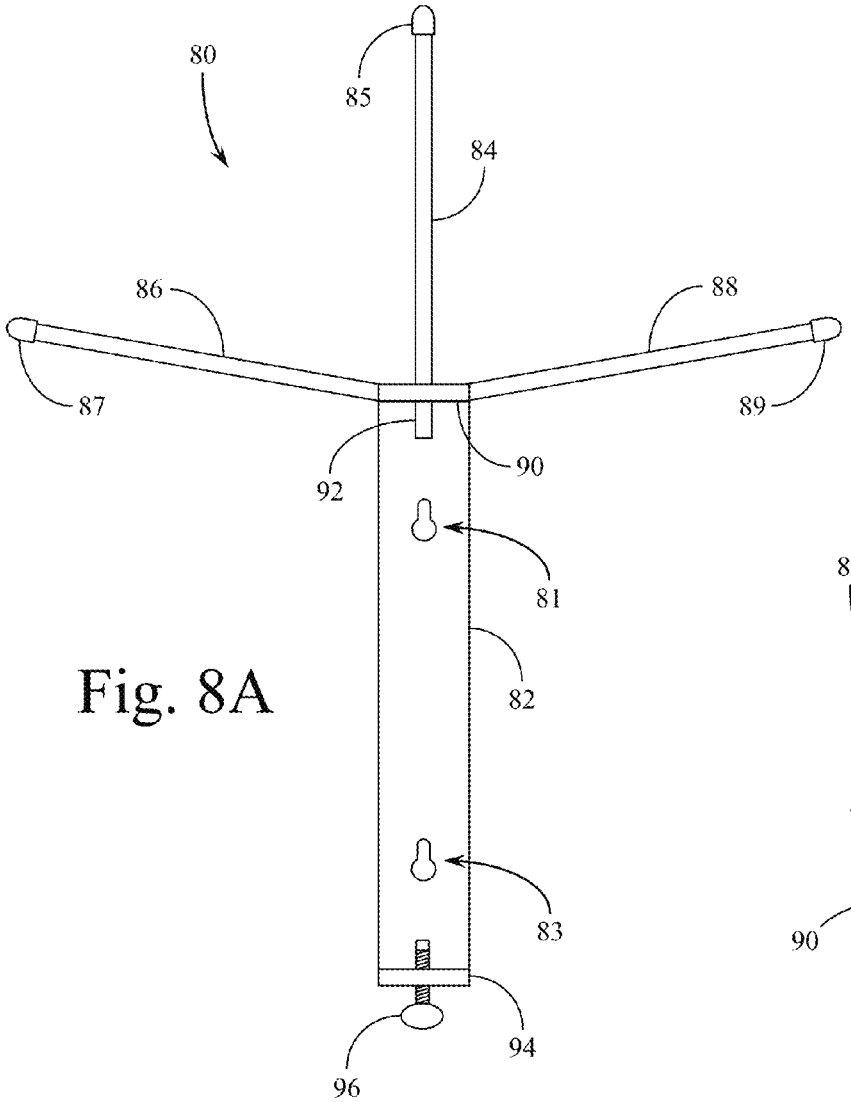
FIG. 8A is an elevational front plan view of an alternate embodiment of the frame component of the bottle cross assembly system of the present invention, suitable for mounting to a wall or fence.
Figure 8B:
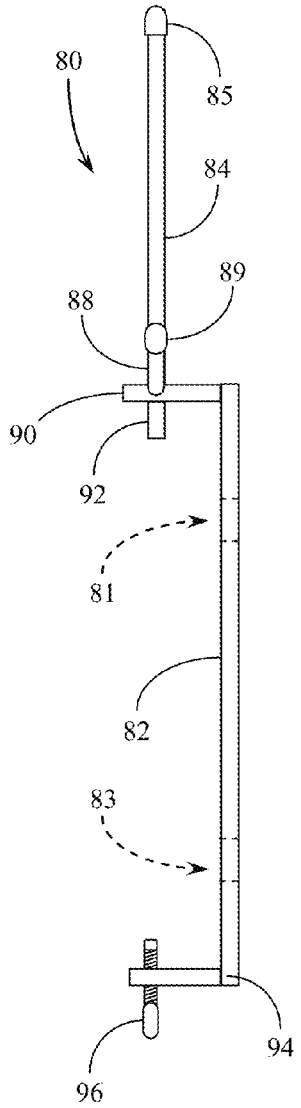
FIG. 8B is an elevational side plan view of the alternate embodiment of the frame component of the bottle cross assembly system of the present invention shown in FIG. 8A.

Reference is finally made to FIGS. 8A & 8B for an alternate preferred embodiment of a wall or fence mounting bracket that eliminates the need for the base rod required for positioning the bottle cross in the ground. If it is anticipated that the bottle cross will only be secured to a wall or fence, the embodiment shown in FIGS. 8A & 8B may be utilized instead of that shown in the previous drawing figures. In FIG. 8A, frame 80 includes base plate 82 in place of the base rod of the previous embodiment. Top post 84 and post cap 85 are essentially the same as the top post and cap shown in the first embodiment. Likewise, first arm 86 and second arm 88 with arm caps 87 & 89 respectively, are essentially the same as those shown in the first embodiment. Center bracket 90 in this alternate embodiment retains top post 84 and first and second arms 86 & 88, again in the same manner as before. Likewise, base pin 92 is secured to the bottom of center bracket 90 so as to receive the base bottle of the constructed bottle cross.

Bottom bracket 94 with adjustable support pin 96 is similar in most respects to the bottom bracket in the first embodiment. Extending between the bottom bracket and the center bracket in the alternate embodiment, however, is base plate 82 which incorporates upper attachment aperture 81 and lower attachment aperture 83. These apertures, centered side to side in the flat plate structure of base plate 82, may be used to secure the bracket to screws or lag bolts positioned on a fence or wall at the appropriate separation distance. It is recognized that the placement of the bracket on the wall should occur prior to the positioning of the bottles onto the frame of the bottle cross so as to provide access to align and secure the screws or bolts through the bracket apertures.

Although the present invention has been described primarily in conjunction with a frame constructed of metal rod, alternate materials may be utilized to form the basic frame configuration. Metal rods in general provide the most rugged and robust framework for a bottle cross that is to be displayed outdoors. Such welded rod components are quite difficult to break or bend and therefore provide long term structural support for a bottle cross construction. The user may repeatedly alter the bottles that are positioned on the frame to vary the specific bottle cross design, and may create many different types of bottle crosses from a single sized frame. It is anticipated that the frame of the present invention might be marketed in a kit that does not contain bottles (leaving such choice up to the user), but does contain the various components necessary to secure the centering washers with adhesive material onto the respective bases of the top and bottom bottles. Suck a kit would include the constructed frame along with the separate washers and adhesive materials to be positioned as the bottle cross is constructed.

Variations in the construction of the bottle cross that might enjoy the benefit of ancillary components are also anticipated. It is not uncommon, for example, to insert light strings, such as small Christmas lights, into bottles with the electrical plug end of the light string extending out of the bottle neck. The frame of the present invention is intended to be constructed of metal rod components that are sufficiently small in diameter compared to the typical wine bottle neck as to permit the insertion of a string of lights in the bottle and allow enough room for the electrical wires to exit the bottle. The bottom bottle and its use of a plug or stopper to prevent the incursion of rain water is not degraded in this function by the passage of a small light string wire between the plug and the inside wall of the neck of the bottle. The plug is preferably tight enough as to seal around the wire as it exits the bottle.

Although the present invention has been described in conjunction with a frame structure directed primarily to bottles of the size and configuration typical of wine bottles, variations of the geometry and size of the frame are anticipated to accommodate a wide range of other types of bottles. While wine bottles have generally straight sides that reduce to slender bottle necks, other types of bottles that do not have straight sides may be utilized. The centering washers described above are intended to accommodate bottle configurations that would otherwise slip to one side or the other to disrupt the overall cross configuration. These attachment and securement features, therefore, allow the structural frame of the present invention to be utilized in conjunction with a wide variety of different bottles.

I claim:

1. A generally cross shaped frame for supporting a plurality of bottles, the frame comprising:

a base rod;

a center bracket fixed and supported at one end of the base rod, the center bracket comprising a base pin extending back along and in parallel spaced alignment with the base rod;

a top rod supported on the center bracket and oriented in opposition to the base rod;

first and second arm rods positioned on the center bracket in orientations generally opposing each other and generally between the orientations of the top rod and the base rod; and a bottom bracket positioned on the base rod at a spaced distance from the center bracket, the bottom bracket comprising a support pin extending towards the center bracket in parallel spaced alignment with the base rod;

wherein the top rod is adapted to receive a first bottle, the first and second arm rods are adapted to receive second and third bottles respectively, and the base and support pins in combination are adapted to receive and secure a fourth bottle.

2. The frame of claim 1 wherein the support pin is linearly adjustable along a line from the bottom bracket towards the center bracket, whereby the support pin of the bottom bracket and the base pin of the center bracket in combination are adapted to first receive and then adjust to secure the fourth bottle.

3. The frame of claim 1 wherein the base rod further comprises a stake portion having a stake point at an end of the base rod opposite the end of the base rod supporting the center bracket.

4. The frame of claim 1 wherein the top rod and the first and second arm rods are fitted with end caps.

5. The frame of claim 1 wherein the base pin of the center bracket further comprises a cylindrical plug forming a stopper, the cylindrical plug adapted for insertion into a neck of the fourth bottle.

6. The frame of claim 1 wherein the first and second arm rods are angled up from the center bracket.

7. The frame of claim 1 wherein the top rod and the first and second arm rods are of approximately equal lengths.

8. A generally cross shaped frame for supporting a plurality of bottles, the frame comprising:

a base rod;

a center bracket fixed and supported at one end of the base rod, the center bracket comprising:

a base pin extending parallel with the base rod from the center bracket; and a cylindrical plug forming a bottle stopper secured onto the base pin;

a top rod supported on the center bracket and oriented in opposition to the base rod;

first and second arm rods positioned on the center bracket in orientations generally opposing each other and generally between the orientations of the top rod and the base rod;

a bottom bracket positioned at a spaced distance from the center bracket on the base rod, the bottom bracket comprising a support pin oriented towards the center bracket, the support pin linearly adjustable along a line from the bottom bracket towards the center bracket; and a frame support member, the support member comprising one of a portion of the base rod, or a removable component engaging the base rod, the support member fixing a position and orientation of the cross shaped frame on an external surface or structure;

wherein the top rod is adapted to receive a first bottle, the first and second arm rods are adapted to receive second and third bottles respectively, and the base and support pins in combination are adapted to first receive and then adjust to secure a fourth bottle.

9. The frame of claim 8 wherein the frame support member comprises an extended portion of the base rod having a stake point at an end of the base rod opposite the end of the base rod supporting the center bracket.

10. The frame of claim 8 wherein the frame support ember comprises a removable component engaging the base rod, the removable component comprising at least two cylindrical sleeves positioned on a wall mounting plate, the cylindrical sleeves oriented to receive and secure the base rod along its length.

11. The frame of claim 8 wherein the top rod and the first and second arm rods are fitted with end caps, the end caps comprising resilient material, the end caps adapted for soft contact with interior walls of the first, second, and third bottles.

12. A bottle cross construction kit, the kit for use with a plurality of bottles for the construction of a bottle cross, the kit comprising:

(a) a generally cross shaped frame, the frame comprising:

(i) a base rod;

(ii) a center bracket fixed and supported at one end of the base rod, the center bracket comprising a base pin extending parallel with the base rod from the center bracket;

(iii) a top rod supported on the center bracket and oriented in opposition to the base rod positioned on the center bracket, the top rod having a rounded end distal to the center bracket;

(iv) first and second arm rods positioned on the center bracket in orientations generally opposing each other and generally between the orientations of the top rod and the base rod; and (v) a bottom bracket positioned on the base rod at a spaced distance from the center bracket, the bottom bracket defining a threaded aperture;

(b) a cylindrical plug bottle stopper for placement on the base pin of the center bracket;

(c) a threaded support pin for adjustable positioning through the threaded aperture of the bottom bracket, the support pin having a rounded end oriented in the direction of the center bracket;

(d) a first centering washer adapted to receive the rounded end of the top rod; and (e) a second centering washer adapted to receive the rounded end of the support pin;

wherein the top rod and the first centering washer in combination are adapted to receive a first bottle, the first and second arm rods are adapted to receive second and third bottles respectively, the base pin and the cylindrical plug bottle stopper in combination are adapted to receive and secure a top of a fourth bottle, and the support pin and the second centering washer in combination are adapted to secure a base of the fourth bottle.

13. The construction kit claim 12 further comprising a plurality of end caps for placement on the distal ends of the first and second arm rods, the plurality of end caps comprising resilient material the end caps adapted for soft contact with interior walls of the second and third bottles.

14. The construction kit of claim 12 wherein the base rod further comprises a stake portion having a stake point at an end of the base rod opposite the end of the base rod supporting the center bracket.

15. The construction kit of claim 12 further comprising a removable support member engaging the base rod, the removable support member comprising at least two cylindrical sleeve elements positioned on a wall mounting plate, the cylindrical sleeve elements oriented to receive and secure the base rod along its length.

16. The construction kit of claim 12 further comprising a quantity of adhesive for securing the first and second centering washers to their respective bottles.

17. The construction kit of claim 12 further comprising the first, second, third, and fourth bottles.

18. The construction kit of claim 17 wherein the first, second, and third bottles are each of approximately equal height and the fourth bottle has a height greater than the height of the first, second, and third bottles.

* * * * *